US011602473B2

(12) United States Patent
Von Siebenthal et al.

(10) Patent No.: US 11,602,473 B2
(45) Date of Patent: Mar. 14, 2023

(54) MOBILIZATION MODULE AND MOBILIZATION FURNITURE

(71) Applicant: VIBWIFE AG, Stettlen (CH)

(72) Inventors: Tobias Nicolas Von Siebenthal, Stettlen (CH); Sophia Anna Bella von Siebenthal, Stettlen (CH); Pascal André Schnell, Bärschwil (CH)

(73) Assignee: VIBWIFE AG, Stettlen (CH)

( * ) Notice: Subject to any disclaimer, the term of this patent is extended or adjusted under 35 U.S.C. 154(b) by 795 days.

(21) Appl. No.: 16/316,329

(22) PCT Filed: Jul. 7, 2017

(86) PCT No.: PCT/EP2017/067076
§ 371 (c)(1),
(2) Date: Jan. 8, 2019

(87) PCT Pub. No.: WO2018/007582
PCT Pub. Date: Jan. 11, 2018

(65) Prior Publication Data

US 2019/0290523 A1 Sep. 26, 2019

(30) Foreign Application Priority Data

Jul. 8, 2016 (EP) ..... 16178745

(51) Int. Cl.
*A61G 13/00* (2006.01)
*A61G 13/04* (2006.01)
(Continued)

(52) U.S. Cl.
CPC ..... *A61G 13/0009* (2013.01); *A61G 13/04* (2013.01); *A61G 13/08* (2013.01);
(Continued)

(58) Field of Classification Search
CPC .. A61G 13/0009; A61G 13/009; A61G 13/04; A61G 13/06; A61G 13/08;
(Continued)

(56) References Cited

U.S. PATENT DOCUMENTS 5,976,097 A * 11/1999 Jensen ..... A47C 7/024 297/330
6,077,293 A * 6/2000 King ..... A61G 13/009 601/98

(Continued)

FOREIGN PATENT DOCUMENTS

| | | |
|---|---|---|
| JP | 2008-079834 A | 4/2008 |
| WO | 2012/075382 A1 | 6/2012 |
| WO | 2014/055348 A1 | 4/2014 |

OTHER PUBLICATIONS

International Search Report dated Sep. 29, 2017 in corresponding International Patent Application No. PCT/EP2017/067076.

*Primary Examiner* — Kendra D Carter
*Assistant Examiner* — Thomas W Greig
(74) *Attorney, Agent, or Firm* — Medler Ferro Woodhouse & Mills PLLC

(57) ABSTRACT

A mobilization module for mobilizing a body part of a patient includes a body part support, a movement mechanics and a drive unit. The body part support is coupled to the movement mechanics. The movement mechanics is adapted to induce a controlled cadenced displacement of the body part support. The controlled cadenced displacement moves the body part support by at least 1 cm or at least 3 cm and preferably by at least 5 cm. The drive unit is connected to the movement mechanics to actuate the movement mechanics.

15 Claims, 7 Drawing Sheets

(51) Int. Cl.

| | |
|---|---|
| ***A61G 13/08*** | (2006.01) |
| ***A61G 13/12*** | (2006.01) |
| ***A61H 1/00*** | (2006.01) |
| ***A61G 15/00*** | (2006.01) |

(52) U.S. Cl.
CPC ..... *A61G 13/123* (2013.01); *A61G 13/1225* (2013.01); *A61G 15/005* (2013.01); *A61H 1/001* (2013.01); *A61H 1/003* (2013.01); *A61G 13/0018* (2013.01); *A61H 2201/1207* (2013.01); *A61H 2201/1626* (2013.01); *A61H 2201/1628* (2013.01); *A61H 2201/1676* (2013.01)

(58) Field of Classification Search
CPC ..... A61G 13/0018; A61G 7/002–018; A61H 1/00; A61H 1/001; A61H 1/003; A61H 1/005; A61H 2201/1676
See application file for complete search history.

(56) References Cited

U.S. PATENT DOCUMENTS

| | | | | |
|---|---|---|---|---|
| 9,901,505 | B2 * | 2/2018 | Bombard | A61H 9/0078 |
| 10,016,328 | B1 * | 7/2018 | Treat | A61H 23/02 |
| 2004/0053753 | A1 * | 3/2004 | Galvez Campos | A61H 1/0255 482/70 |
| 2004/0103475 | A1 * | 6/2004 | Ogawa | A61G 7/057 5/613 |
| 2005/0222523 | A1 * | 10/2005 | Splane, Jr. | A61H 1/001 601/24 |
| 2005/0272566 | A1 | 12/2005 | Otsuka | |
| 2009/0094744 | A1 * | 4/2009 | Benzo | A61G 7/015 5/608 |
| 2014/0088466 | A1 * | 3/2014 | Hansen | A63B 21/4015 601/34 |
| 2016/0324713 | A1 * | 11/2016 | Halperin | A61H 9/0078 |

* cited by examiner

MOBILIZATION MODULE AND MOBILIZATION FURNITURE

TECHNICAL FIELD

The present invention relates to a mobilization module for mobilizing a body part of a patient and a respective mobilization furniture.

BACKGROUND ART

In many medical or therapeutic application or therapies it is desired to mobilize a body part of a patient. For example, in orthopaedics it often is important to move a body part of a patient in therapy, e.g., following a surgical intervention or a trauma of the musculoskeletal system of the patient. Thereby, it is known to train the patient to perform specific exercises for moving the body part in an appropriate manner or a physiotherapist to apply a controlled moving of the body part on the patient. For making the therapy of patients more efficient and to disburden the involved therapist, it is known to use specific devices repeatedly moving the body part.

Another application where controlled movements of body parts can be desired is birth. During birth, the child's head moves down with contractions. In order to do so, it is important that the child is properly positioned. A wrong position of the child can be a key factor that the birth is prolonged or stalled. If birth doesn't progress in a given time period, it is common practice to perform a caesarean section at a certain point.

The better or the more appropriate the child is positioned in each stadium of birth, the faster and less cumbersome the birth process usually is. Therefore, during birth midwives typically guide the mother to do movements and get into positions for supporting a proper positioning of the child. Those movements and positions can be of high importance for the birth success. The positive impacts of continuously positioning the woman and moving her birth canal are proven in various scientific studies.

However, in case of a high workload or for other reasons of efficiency, the midwife is not capable of repositioning the birthing woman every few minutes. The active positioning and movement of the woman requires a high physical and time-consuming effort of the midwife. Also, the physical condition often do not allow to support the woman properly. As a consequence, the midwives' skills often are not applied appropriately which again increases the chance of a prolonged birth or an unplanned caesarean section.

Therefore, there is a need for a system allowing to efficiently move a body part of a patient in therapy.

DISCLOSURE OF THE INVENTION

According to the invention, this need is settled by a mobilization module as it is defined by the features of independent claim 1, and by a mobilization furniture as it is defined by the features of independent claim 14. Preferred embodiments are subject of the dependent claims.

In more detail, the present invention deals with a mobilization module for mobilizing a body part of a patient. The mobilization module comprises a body part support, a movement mechanics and a drive unit. The body part support is coupled to the movement mechanics. The movement mechanics is adapted to induce a controlled cadenced displacement of the body part support. The controlled cadenced displacement moves the body part support by at least 1 cm, at least 2 cm, at least 3 cm, at least 4 cm, at least 6 cm, at least 7 cm, at least 8 cm, at least 9 cm or at least 10 cm and preferably by at least 5 cm. The drive unit is connected to the movement mechanics to actuate it.

In connection with the invention, the term "body part" can relate to body parts in the narrow sense as well as to sections thereof, groups thereof or the like. Body parts of this kind can, e.g., be a back, a neck, a leg, a foot, a toe, a pelvis or the like. The term can particularly define the unit of the body which is intended to be moved by the mobilization device for therapeutic or other reasons.

The body part support is a structure which is designed to accommodate the body part of the patient to be mobilized or any other body part which is suitable for inducing a movement of the patient's body part to be mobilized. Thereby, it is essential that the body part support is designed to allow moving the body part in order to be capable of achieving a therapeutic effect. For that reason, the body part support or at least a complete section thereof receiving the body part preferably is rigid such that it is moved as one single unit. By moving the body part support or the section thereof receiving the body part in one, the controlled cadenced displacement can be transferred to the body part such that the complete body part adopts the controlled cadenced displacement motion. Thereby, the body part support or the section thereof receiving the pelvis can be completely stiff or still gently elastic. For example, it can be a plate-like or multi-plate like unit and can have an essentially flat surface for receiving the body part such as a pelvis of a mother. It can be equipped with an easily cleanable pillow and/or a protection cover such as a single use cover.

Like this, in use, the mobilization module according to the invention moves the complete body part of the patient in a way which may induce a therapeutic reaction. For example, by moving a pelvis of a mother, a child can be motivated to rearrange its position in the birth channel. This can advance the birth process. Also, for the mother herself the motions of the complete pelvis may have a beneficial effect on the birth process. It is to note that the motions induced in the patient's body part by the mobilization module are essentially different from massage like manipulations induced by known devices. For example, whereas it is known that pressing and moving small sections of the mother's back and in particular the back muscles may increase the well-being of the mother and thereby indirectly assisting the birth process, the mobilization module according to the invention allows to manipulate or move the complete pelvis to a predefined extent and in predefined motions which directly influences the birth process.

The term "coupled" as used in connection with the body part support and the movement mechanics can relate to a mechanical connection between the body part support and the movement mechanics. In particular, the body part support can be directly or indirectly mounted to a part of the movement mechanics.

The mobilization module according to the invention allows for assisting the patient to move appropriately during therapy. In particular, by moving the body part of the patient in an appropriate form and to a sufficient extent, the patient automatically performs the necessary movements which might improve the effects of the therapy. It can essentially ease the overall therapy process. Furthermore, the mobilization module can assist the therapist during therapy such that his load can be significantly reduced. Also, the mobilization module allows for a comparably safe and easy implementation of therapeutic movements. Like this, the patient himself can use the mobilization unit, e.g., at home and no supervision of a therapist is necessary.

The term "controlled cadenced displacement" as used in connection with the body part support can relate to a predefinable or predefined displacement, i.e. dislocation or relocation, which is continuously repeated. Thereby, for allowing the induced motion of the body part to assist the mobilization or therapeutic process, the repetition rate has to be appropriately set. For example, the controlled cadenced displacement can relate to a motion of the pelvis support repeated every 0.5 seconds (s), every second, every 2 s, every 5 s, every 10 s, every 20 s or every 30 s. In any case, the repetition rate should neither be too short, such as for instance 0.1 s or less, since such quick movements (shaking movement) of the body part may disturb the mobilization or therapeutic process rather than assisting it, nor be too long, such as for instance 1 minute or more, since such slow movements may not influence the mobilization or therapeutic process.

The controlled cadenced displacement of the body part support can be a motion in any desirable shape or form. More specifically, it can be any displacement causing a motion of the body part which assists the therapy of the patient. In particular, it can comprise a lateral motion such as a left right motion, a longitudinal motion such as a back and forth motion, a vertical motion such as an up and down motion, a tilting motion about an axis or any combination thereof.

As described above, the body part support or the section thereof receiving the body part advantageously is rigid. Therefore, the extent of motion of the body part support effected by the controlled cadenced displacement relates to the complete body part support or the complete mentioned section thereof. The movement by at least 1 cm, at least 2 cm, at least 3 cm, at least 4 cm, at least 6 cm, at least 7 cm, at least 8 cm, at least 9 cm or at least 10 cm and preferably by at least 5 cm relates to any movement at any position of the body part support or the mentioned section thereof. I.e., at least at one position of the rigid body part support or the mentioned rigid section thereof the movement has to be to the extent described. For example, if the rigid body part support is tilted such that it is lifted up and down at one lateral side and not lifted at the other lateral side, in accordance with the invention, the lifting motion has to be to the extent described.

Preferably, the controlled cadenced displacement of the body part support induced by the movement mechanics comprises an eight motion of the body part support. The eight motion of the body part support can be transferred to the body part of the patient when being properly placed on the mobilization module. Such eight motions can efficiently assist the therapy such as a for mobilizing the back of the patient. In particular, compared to other motions such as linear or circular motions eight motions can more efficiently appropriately move the body part or back such that the therapy can be comparably easy and less cumbersome for the patient as well as for a therapist involved.

Preferably, the movement mechanics comprises a rocker member coupled to the body part support. The term "rocker member" as used in this connection can relate to a structure allowing for tilting the body part support. In particular, the rocker member allows for vertically moving the body part support up and down in an alternating fashion. By inducing a tilting movement, the rocker member can provide for a motion of the body part of the patient which can efficiently assist therapy. Particularly, the tilting induced by the rocker member can be a vertical portion of the eight motion mentioned above. Advantageously, the rocker member can be arranged to allow tilting to a specific predefined extent.

Thereby, the rocker member of the movement mechanics preferably is oriented such that the body part support laterally tilts when the controlled cadenced displacement of the body part support is induced by the movement mechanics. In this connection the term "laterally" relates to a direction in a situation when the mobilization module is arranged as being applied. Thereby, laterally can relate to a sideward direction of the patient. Thus, laterally tilting can be a sidewise or left and right alternating vertical or up and down or front and back motion of the body part support. This can induce a tilting of a coronal, transversal or sagittal plane of the patient at his body part. Such a lateral tilting of the body part can be particularly beneficial for assisting the patient during therapy.

Preferably, the mobilization module comprises a first lateral hinge component and a second lateral hinge component. Thereby, the body part support has a central section passing over into a first lateral section at a first lateral side and passing over into a second lateral section at a second lateral side opposite to the first lateral side of the central section, the first lateral hinge component holds the body part support where the central section passes over into the first lateral section, and the second lateral hinge component holds the body part support where the central section passes over into the second lateral section. By having the hinge components and by providing the body part support with the three sections the body part support can be moved in a wave like manner. Thereby, the wave can be oriented in any suitable direction and orientation. In particular, the wave can be a lateral wave from one side to the other.

Thereby, the mobilization module preferably comprises a first length adjustable rest connecting the rocker member of the movement mechanics to the first lateral hinge component and a second length adjustable rest connecting the rocker member of the movement mechanics to the second lateral hinge component. Advantageously, the first and second length adjustable rests are connected to or carry the body part support and particularly the central section thereof. Such arrangement allows for efficiently providing a movement of the body part in a lateral as well as in a vertical direction.

Preferably, the movement mechanics comprises a shifting member directly or indirectly coupled to the body part support, wherein the shifting member laterally shifts the body part support when the controlled cadenced displacement of the body part support is induced by the movement mechanics. Such a shifting member allows for laterally displacing the body part support in relation to the movement mechanics. This allows for providing a sophisticated movement to the body part of the patient which is designed to efficiently assisting therapy. In particular, the lateral shifting can be a lateral portion of the eight motion mentioned above Thereby, the shifting member of the movement mechanics preferably comprises a rail and a carriage which is slidably arranged on the rail wherein the carriage is coupled to the body part support. Such an arrangement can be a robust and precise embodiment of the shifting member.

In one preferred embodiment, the movement mechanics comprises a rotator and a notch mounted to the rotator offset of an axis of rotation of the rotator, the rocker member of the movement mechanics comprises a central rest supporting the body part support and the notch engages a recess of the central rest. The rotator can be an arm or rod rotatably mounted around the rotational axis and the notch being attached offset the rotational axis at the arm or rod. Particularly, the rotator can be a circular disc symmetrically rotatable around its centre. Thereby, the notch can be attached offset or distant from the centre to the disc. By means of such a rotator a non-round motion can efficiently be implemented or generated. In particular, by having the notch inter-engaging the central rest, such rotator can efficiently transform a rotational movement into a linear movement such as a left and right shifting of the body part support. This allows for efficiently implementing the movement mechanics.

In another preferred embodiment, the drive unit comprises a strap connected to the rocker member of the movement mechanics, such that the rocker member is tiltable by manipulating the strap. Thereby, the strap preferably extends along the rocker member such that the rocker member is tiltable in one way by pulling the strap in one direction and in the other way by pulling the strap in the opposite other direction. Such arrangement involving the strap allows for achieving an appropriate tilting mechanism by requiring comparable few space. Thus, such arrangement allows for achieving a compact design of the mobilization module which can efficiently be used and/or conveniently be integrated, e.g., in a mobilization furniture.

Thereby, the recess of the central rest of the rocker member of the movement mechanics preferably is a longitudinal groove. In an advantageous embodiment the longitudinal groove extends in a longitudinal direction of the mobilization module, i.e., a direction essentially perpendicular to lateral or the sideward direction mentioned above.

Preferably, the drive unit comprises an electromotor coupled to the movement mechanics. In one embodiment, the electromotor drives the rotor. Such electromotor allows for an efficient, strong and comparably cheap implementation of the drive unit.

Preferably, the mobilization module comprises a housing in which the movement mechanics and the drive unit are arranged and which is covered by the body part support. Such a housing may provide protection for the parts being arranged inside. Furthermore, it allows for efficiently handling such as transporting and placing the mobilization module.

Preferably, the mobilization module comprises a control unit arranged to predefine the controlled cadenced displacement of the body part support induced by the movement mechanics. Such control unit may have a processing apparatus such as a computer or the like, a display and a user interaction device. Such control unit allows the therapist or the patient himself to adjust the movement induced by the mobilization module. Such adjusting may be performed before and also during birth.

Preferably, the mobilization module has a halting structure adapted to stop the controlled cadenced displacement of the body part support at a predefined position of the body part support. By means of such a halting structure the body part support, typically together with the body part arranged thereon, can be held in the predefined position. This allows for intermediately or finally interrupting the displacement of the body portion. Such static placement of the body part in a particular position can be desired in various applications of the mobilization module.

For example, in birth it can be advantageous to hold the pelvis of the mother in a particular position such as a lateral position or the like. This allows for inducing the child to move in an appropriate position which can be particularly desired in cases of cephalic presentations, rotations, deep transverse arrests or the like.

Also such halting structure can be useful in therapeutic applications, e.g., where a static stretching is desired by positioning the body part in a particular manner. Or, such halting structure can be helpful in medical applications. For example, when using the mobilization module in gastroenterology holding the pelvis in a predefined position may ease setting a rectal catheter.

The halting structure can be comprised by the movement mechanics and the drive unit. It can additionally or alternatively be implemented by the control unit. For example, the halting structure can be embodied within a computer program or software run by the control unit or by another unit.

The predefined position can be a position in which the body part support is tilted from a typically horizontal zero position such that the body part support is inclined.

Advantageously, the halting structure is adapted to stop the controlled cadenced displacement of the body part support at a plurality of predefined positions of the body part support. This can be desired in various applications of the mobilization module such as in birth when the pelvis of the mother has to periodically change its position, e.g., in cases of rollover or the like.

Thereby, the halting structure can be adapted to stop the controlled cadenced displacement of the body part support at positions where the body part support is tilted by 2.5° from the zero position, 5° from the zero position, 7.5° from the zero position, 10° from the zero position, 12.5° from the zero position, 15° from the zero position, 17.5° from the zero position and 20° from the zero position or any other combination thereof.

The present disclosure also comprises embodiments of mobilization modules in which the body part support is not mandatorily displaceable in a controlled cadenced manner. Rather, the mobilization module can be embodied with the halting structure to displace the body part support into the predefined position without any cadence or the like.

Another aspect of the present invention relates to a mobilization furniture. It comprises a rest portion and a body part portion with a body part support, a movement mechanics and a drive unit. The body part support of the body part portion is coupled to the movement mechanics of the body part portion. The movement mechanics of the body part portion is adapted to induce a controlled cadenced displacement of the body part support of the body part portion. The controlled cadenced displacement moves the body part support of the body part portion by at least 1 cm, at least 2 cm, at least 3 cm, at least 4 cm, at least 6 cm, at least 7 cm, at least 8 cm, at least 9 cm or at least 10 cm and preferably by at least 5 cm. The drive unit of the body part portion is connected to the movement mechanics of the body part portion to actuate the movement mechanics of the body part portion.

The term "mobilization furniture" as used herein relates to a furniture which is shaped and designed for accommodating a patient during therapy or a mother during birth. It can be a chair like or bed like furniture and particularly a birthing bed, a delivery bed, a delivery chair or a birthing chair. Such mobilization furniture usually has a section where the body part of the patient such as a pelvis of a mother is placed and a rest section for supporting the patient or mother in order to allow to be safely and comfortable positioned. In some embodiments they have a leg section where the legs of the patient or mother are at least partially placed during birth. Thereby, the leg section frequently is shortened such that a midwife or a doctor can comfortably access the patient or mother.

The mobilization furniture according to the invention and the preferred embodiments thereof described below allow for implementing the effects and benefits of the mobilization module described above and of its corresponding preferred embodiments.

Preferably, the controlled cadenced displacement of the body part support of the body part portion induced by the movement mechanics of the body part portion comprises an eight motion of the body part support. The movement mechanics of the body part portion preferably comprises a rocker member coupled to the body part support of the body part portion. Thereby, the rocker member of the movement mechanics of the body part portion preferably is oriented such that the body part support of the body part portion laterally tilts when the controlled cadenced displacement of the body part support of the body part portion is induced by the movement mechanics of the body part portion.

The body part portion preferably comprises a first lateral hinge component and a second lateral hinge component, wherein the body part support of the body part portion has a central section passing over into a first lateral section at a first lateral side and passing over into a second lateral section at a second lateral side opposite to the first lateral side of the central section, the first lateral hinge component of the body part portion holds the body part support of the body part portion where the central section passes over into the first lateral section, and the second lateral hinge component of the body part portion holds the body part support of the body part portion where the central section passes over into the second lateral section.

Thereby, the body part portion preferably comprises a first length adjustable rest connecting the rocker member of the movement mechanics of the body part portion to the first lateral hinge component of the body part portion and a second length adjustable rest connecting the rocker member of the movement mechanics of the body part portion to the second lateral hinge component of the body part portion.

Preferably, the movement mechanics of the body part portion comprises a shifting member coupled to the body part support of the body part portion, wherein the shifting member laterally shifts the body part support of the body part portion when the controlled cadenced displacement of the body part support of the body part portion is induced by the movement mechanics of the body part portion. Thereby, the shifting member of the movement mechanics of the body part portion preferably comprises a rail and a carriage which is slidably arranged on the rail, wherein the carriage is coupled to the body part support of the body part portion.

In one preferred embodiment, the movement mechanics of the body part portion comprises a rotator and a notch mounted to the rotator offset an axis of rotation, the rocker member of the movement mechanics of the body part portion comprises a central rest supporting the body part support of the body part portion, and the notch engages a recess of the central rest. Thereby, the recess of the central rest of the rocker member of the movement mechanics of the body part portion preferably is a longitudinal groove.

In another preferred embodiment, the drive unit comprises a strap connected to the rocker member of the movement mechanics, such that the rocker member is tiltable by manipulating the strap. Thereby, the strap preferably extends along the rocker member such that the rocker member is tiltable in one way by pulling the strap in one direction and in the other way by pulling the strap in the opposite other direction. Such arrangement involving the strap allows for achieving an appropriate tilting mechanism by requiring comparable few space. Thus, such arrangement allows for achieving a compact design which can efficiently be integrated in the mobilization furniture.

Preferably, the drive unit of the body part portion comprises an electromotor coupled to the movement mechanics of the body part portion. Preferably, the mobilization furniture comprises a control unit arranged to predefine the controlled cadenced displacement of the body part support of the body part portion induced by the movement mechanics of the body part portion.

Preferably, the mobilization furniture has a halting structure adapted to stop the controlled cadenced displacement of the body part support at a predefined position of the body part support. Such halting structure can be identically embodied for similar purposes as the halting structure of the mobilization module described above.

Preferably, a mobilization module as described above is integrated in the body part portion of the mobilization furniture.

Preferably, the body part support of the mobilization furniture or at least a complete section thereof receiving the body part is rigid.

BRIEF DESCRIPTION OF THE DRAWINGS

The mobilization module and the mobilization furniture according to the invention are described in more detail herein below by way of exemplary embodiments and with reference to the attached drawings, in which.

DESCRIPTION OF EMBODIMENTS

In the following description certain terms are used for reasons of convenience and are not intended to limit the invention. The terms "right", "left", "up", "down", "under" and "above" refer to directions in the figures. The terminology comprises the explicitly mentioned terms as well as their derivations and terms with a similar meaning. Also, spatially relative terms, such as "beneath", "below", "lower", "above", "upper", "proximal", "distal", and the like, may be used to describe one element's or feature's relationship to another element or feature as illustrated in the figures. These spatially relative terms are intended to encompass different positions and orientations of the devices in use or operation in addition top the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. The devices may be otherwise oriented (rotated 90 degrees or at other orientations), and the spatially relative descriptors used herein interpreted accordingly. Likewise, descriptions of movement along and around various axes includes various special device positions and orientations.

To avoid repetition in the figures and the descriptions of the various aspects and illustrative embodiments, it should be understood that many features are common to many aspects and embodiments. Omission of an aspect from a description or figure does not imply that the aspect is missing from embodiments that incorporate that aspect. Instead, the aspect may have been omitted for clarity and to avoid prolix description. In this context, the following applies to the rest of this description: If, in order to clarify the drawings, a figure contains reference signs which are not explained in the directly associated part of the description, then it is referred to previous or following description sections. Further, for reason of lucidity, if in a drawing not all features of a part are provided with reference signs it is referred to other drawings showing the same part. Like numbers in two or more figures represent the same or similar elements.

Figure 1:
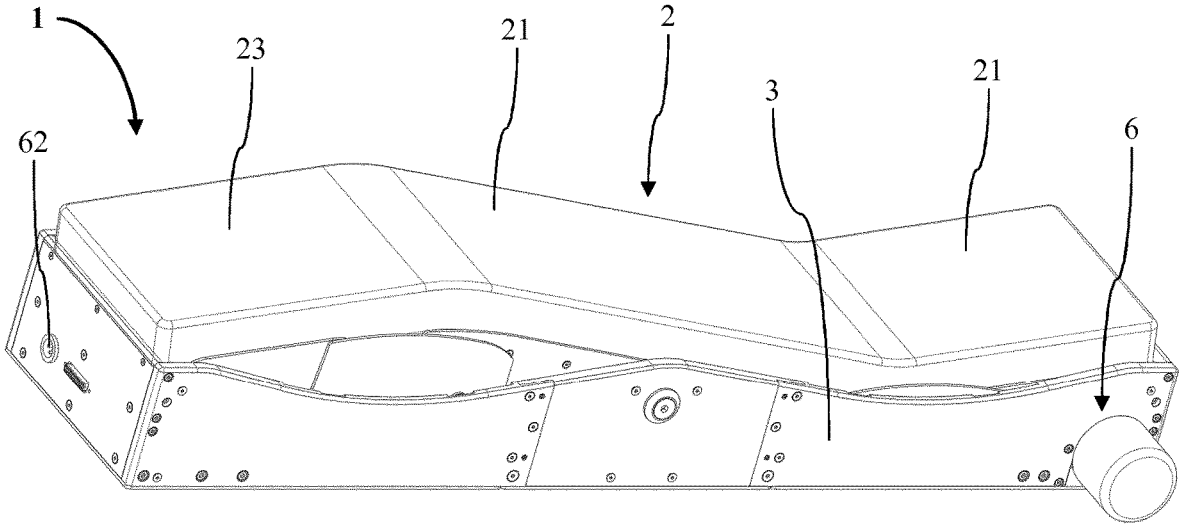
FIG. 1 shows a perspective view of a first embodiment of a mobilization module according to the invention.

FIG. 1 shows a first embodiment of a mobilization module 1 according to the invention. The mobilization module 1 is arranged for being used in a therapy of a back of patient or for assisting a mother during birth. The mobilization module 1 comprises a pelvis support 2 as body part support having a central section 21 as section intended to receive the complete pelvis, a right hand first lateral section 22 and a left hand second lateral section 23. The central section 21 passes foldably over into the first lateral section 22 at its right hand lateral end side and passes foldably over into the second lateral section 23 at its left hand end side. The central section 21 is laterally tilted such that in FIG. 1 its right hand lateral end side is lower than its left hand lateral end side. The pelvis support 2 is equipped with a soft and easily cleanable surface in order to allowing a convenient arrangement of the pelvis of the patient or mother.

The mobilization module 1 further comprises a housing 3 and a drive unit 6. The housing 3 surrounds and protects most of the components of the mobilization module 1. It further allows for conveniently transporting the mobilization module 1. The drive unit 6 has a power connector 62 which is arranged at the housing 3.

Figure 2:
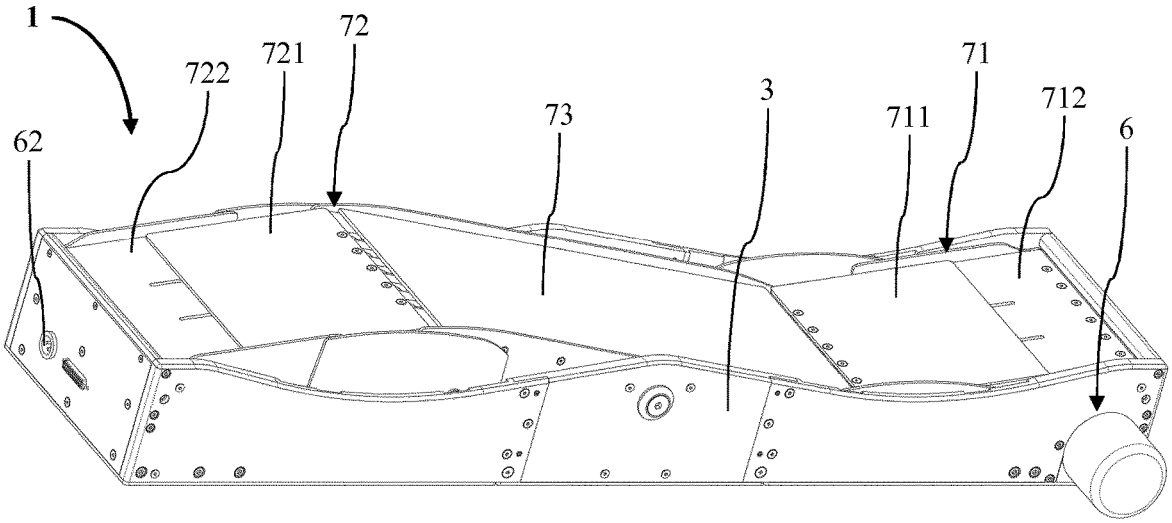
FIG. 2 shows the mobilization module of FIG. 1 wherein a body part support is removed.

In FIG. 2 the mobilization module 1 is shown wherein the pelvis support 2 is removed. Thereby, it can be seen that it is equipped with a right hand first length adjustable rest 71 and a left hand second length adjustable rest 72. The first and second length adjustable rests 71, 72 each have a surface sheet 711, 721. As can be seen at the left-hand side of the mobilization module 1, the second length adjustable rest 72 has two parts which are laterally movable relative to each other. In particular, a left surface sheet 722 of it is connected to the left end side of the housing 3 and is shiftable below the right surface sheet 721. Like this, the second length adjustable rest 72 can be modified in length depending on a tilting position of the central section 21 of the pelvis support 2. The right part of the surface sheet 721 of the second length adjustable rest 72 is connected to the second section 23 of the pelvis support 2 (not shown in FIG. 2). The first length adjustable 71 rest is analogously designed and connected to the first section 22 of the pelvis support 2 (not shown in FIG. 2). The central section 21 of the pelvis support 2 (not shown in FIG. 2) is connected to a central sheet 73.

Figure 3:
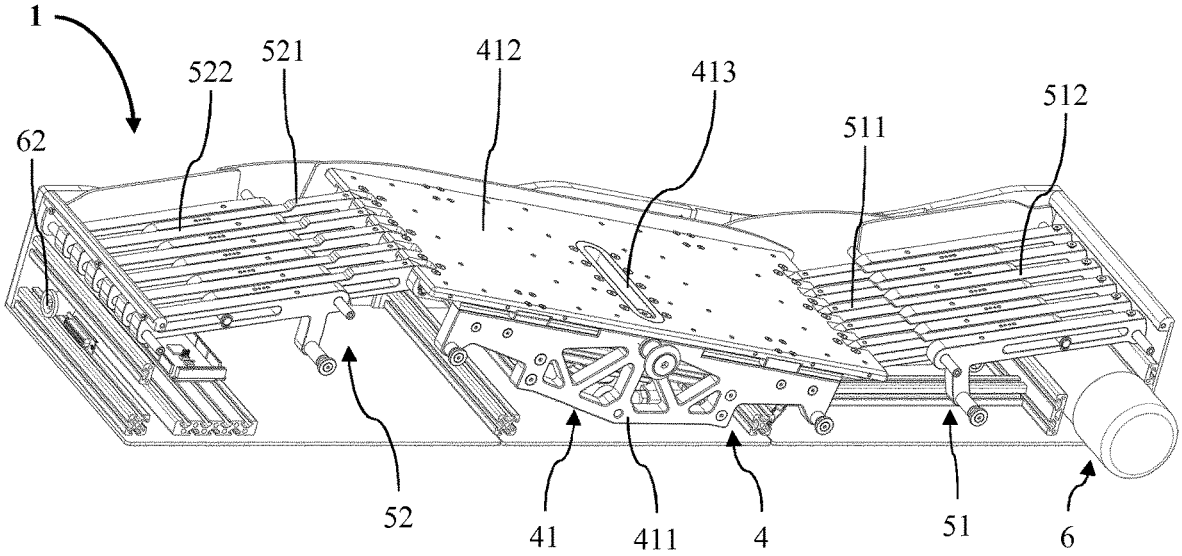
FIG. 3 shows a perspective view of the mobilization module of FIG. 1 partially disassembled.

FIG. 3 shows the mobilization module 1 partially disassembled such that the interior of the housing 3 is visible in more detail. Thereby, it can be seen that the mobilization module 1 has a movement mechanics 4, a right hand first lateral hinge component 51 and a left hand second lateral hinge component 52. The movement mechanics 4 comprises a rocker member 41 with two parallel angle arcs 411. The angle arcs 411 extend in a lateral direction and each has two lateral legs connected via an angle. Thereby, the angle defines a maximum tilting extent of the movement mechanics 4 and the pelvis support 2 coupled thereto (not visible in FIG. 3).

The rocker member 41 further comprises a plate shaped central rest 412 which defines a flat top surface of the rocker member 41 onto which the central surface sheet 73 is connected (not visible in FIG. 3). In its middle the central rest 412 is equipped with a longitudinal groove 413 which extends in a longitudinal direction of the mobilization module 1.

At the left hand lateral side of the rocker member 41 the second hinge component 52 is mounted to the rocker member 41. It comprises five laterally extending and spaced primary rods 521 and six laterally extending and spaced secondary rods 522. Each of the primary rods 521 lies between two adjacent secondary rods 522. At the right hand side the primary rods 521 are connected to the rocker member 41 in a swivelling enabled fashion. At the left hand side the secondary rods 522 are connected to the housing 43 in a swivelling enabled fashion. The primary and secondary rods 521, 522 are shiftable in a lateral direction to each other. Like this, the length of the second hinge component can be adjusted in accordance with the tilting position of the rocker member 41. More particularly, in the position shown in FIG. 3 in which the rocker member 41 is to a maximum extent tilted to the right hand side, the first lateral hinge component 51 has a minimal length, i.e. its primary and secondary rods 512 are shifted completely towards each other, and the second lateral hinge component 52 has a maximum length, i.e. its primary and secondary rods 521, 522 are pulled apart to a maximum extent.

Figure 4:
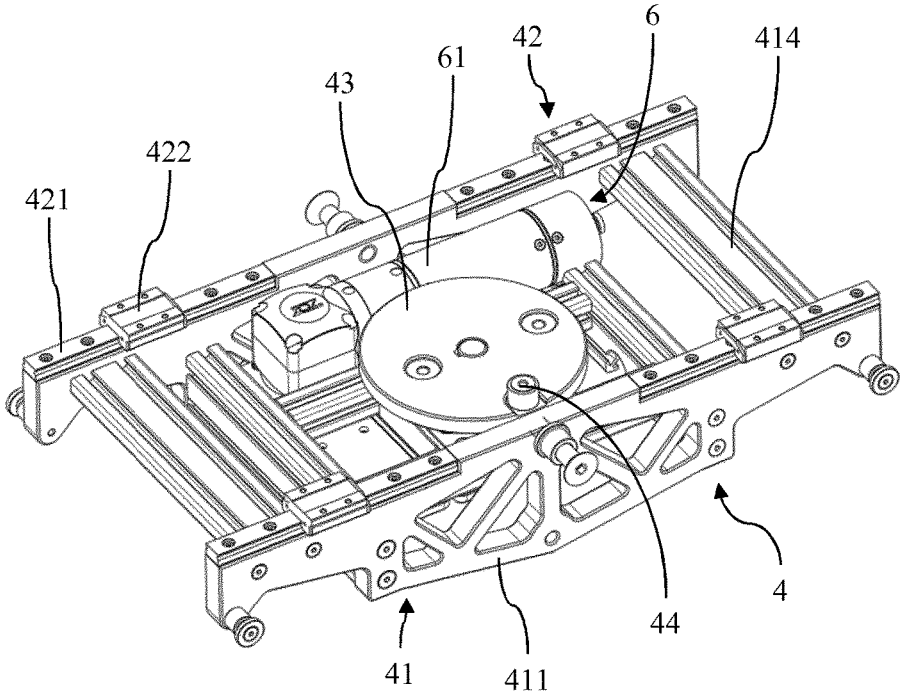
FIG. 4 shows a perspective view of a movement mechanics of the mobilization module of FIG. 1.

In FIG. 4, the movement mechanics 4 are shown in more detail. At their end regions the two angle arcs 411 are interconnected by two bars 414 of the rocker member 41 which are fixedly screwed to the angle arcs 411. Like this, the angle arcs 411 together with the bars 414 from a robust unit.

Onto the angle arcs 411 of the rocker member 41 a shifting member 42 of the movement mechanics 4. The shifting members 42 comprises rails 421 extending along the top side of the angle arcs 411 and carriages 422. Each of the carriages 422 engages one of the rails 421 such that the carriages 422 can slide along the rails 421 and the angle arcs 411. In an assembled status the central rest 412 of the rocker member 41 is mounted to the carriages 421. Like this, the central rest 412 together with the central section 51 of the pelvis support 2 can be laterally shifted when a controlled cadenced displacement of the pelvis support 2 is induced by the movement mechanics 4.

The movement mechanics 4 further comprises a circular disc 43 and a notch 44. The disc 43 is pivotably mounted such that it can be rotated around an axis extending through its centre. It is further coupled to an electromotor 61 of the drive unit 6 via a drive belt. Like this, the disc 43 can be rotated by the electromotor 61. The notch 44 is mounted to the disc 43 offset its centre. It vertically extends from a top surface of the disc 43 in an upward direction.

Figure 5:
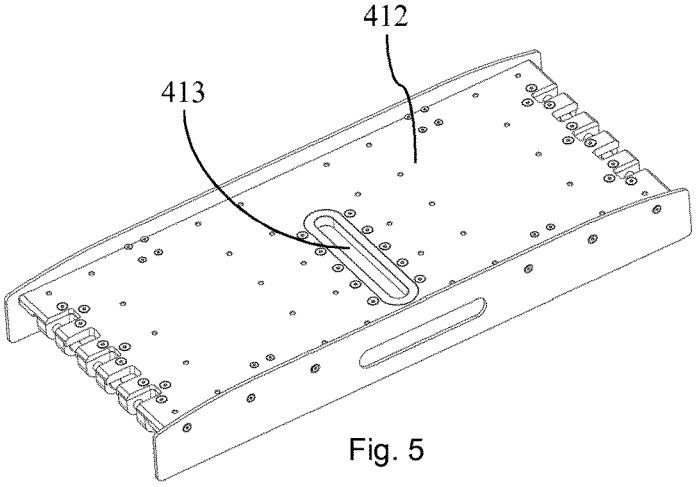
FIG. 5 shows a perspective view of a central rest of mobilization module of FIG. 1.

As can be best seen in FIG. 5, the groove 413 of central rest 412 of the rocker member 41 is shaped and located to receive the notch 44 when the central rest is mounted to the carriages 421. Like this, by a rotation of the disc 43 the notch 44 bidirectionally shifts the central rest 412 along the rails 421 and, thus, along the rocker member 41, i.e. in a lateral direction. In the meantime, the notch 44 moves along the groove 413 such that the rotational movement of the disc 43 does not induce a displacement of the central rest 412 in a direction other than a lateral direction.

Figure 6:
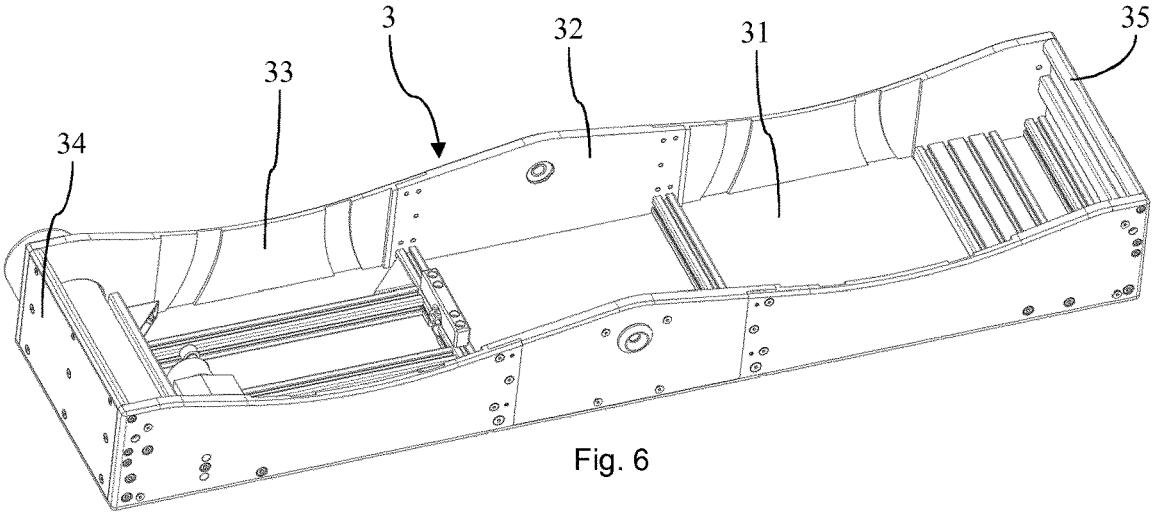
FIG. 6 shows a perspective view of a housing of the mobilization module of FIG. 1.

FIG. 6 shows the housing of the mobilization module 1 in more detail. Thereby it can be seen that it has a rectangular base plate 31. From the longitudinal ends of the base plate 31 a first side wall 35 and a second sidewall 34 vertically extend. The sidewalls 34, 35 are interconnected by a first length wall 32 and a second length wall 33. The length walls 32, 33 have a wave like top end portion which allows the tilting displacement and the eight movement of the pelvis support 2.

Figure 7:
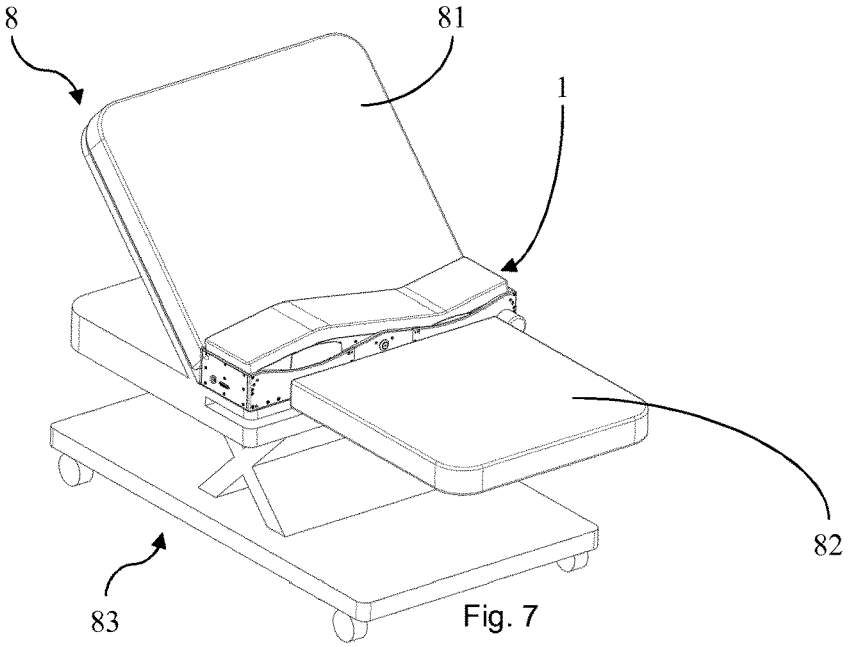
FIG. 7 shows a perspective view of a birth furniture as an embodiment of a mobilization furniture according to the invention.

In FIG. 7 an embodiment of a birth furniture 8 as an embodiment of a mobilization furniture according to the invention is shown. It comprises a rest portion 81 and a shortened leg portion 82. In between the rest portion 81 and the leg portion 82 the mobilization module 1 described above in connection with FIG. 1 to FIG. 6 is incorporated into the birth furniture 8 as body part support. The rest portion 81, the leg portion 82 and mobilization module 1 are mounted to a support frame 83. The support frame 83 is adjustable such that the rest portion 81 and the leg portion 82 can be configured in accordance to the person which is placed on the birth furniture 8.

Figure 8:
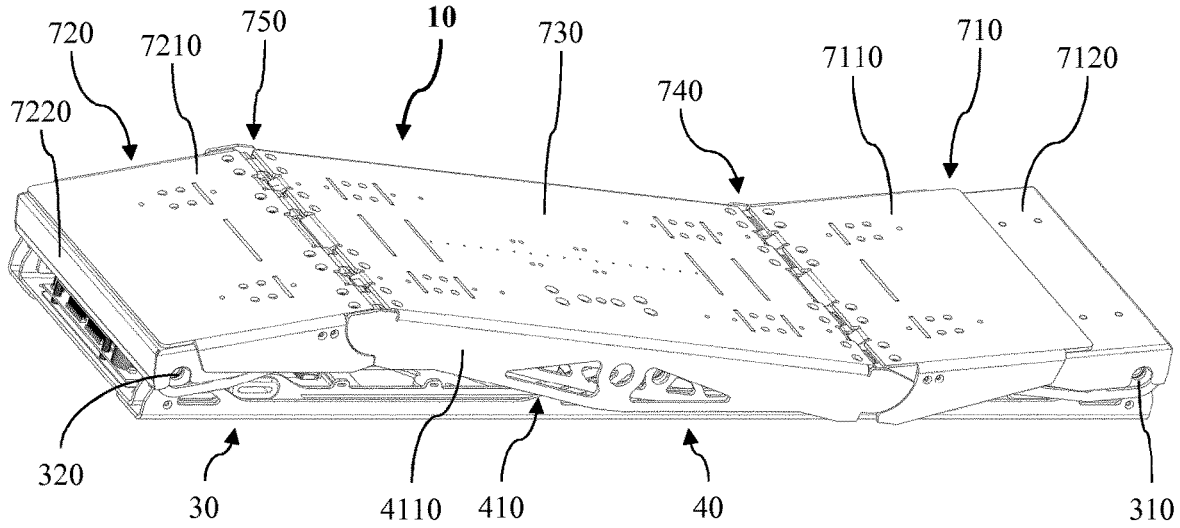
FIG. 8 shows a perspective view of a second embodiment of a mobilization module according to the invention.

FIG. 8 shows a second embodiment of a mobilization module 10 according to the invention. The mobilization module 10 is designed for being used in a therapy of a back of patient or for assisting a mother during birth. The mobilization module 10 comprises a central back or pelvis support 730 as rigid central section of a body part support. The back or pelvis support 730 is laterally tilted such that in FIG. 8 its right hand lateral end side is lower than its left hand lateral end side.

The mobilization module 10 further comprises a frame 30 of a housing. The frame 30 forms a basis to which the other parts of the mobilization module 10 are directly or indirectly mounted. The housing further comprises side covers (not visible in FIG. 8) which surround and protect most of the components of the mobilization module 10.

The mobilization module 10 has a movement mechanics 40 with rocker flanks 410 of a rocker member. The rocker flanks 410 comprise two parallel angle arc plates 4110 extending in a lateral direction. Thereby, the angle arc plates 4110 define a maximum tilting extent of the movement mechanics 40 and the back or pelvis support 730 coupled thereto.

The mobilization module 10 is equipped with a right-hand length adjustable first rest 710 as first lateral section of the body part support and a left hand length adjustable second rest 720 as second lateral section of the body part support. The first and second length adjustable rests 710, 720 each have a surface sheet 7110, 7210 and a support sheet 7120, 7220. The surface sheet 7110 of the first rest 710 lies on top of the support sheet 7120 of the first rest 710 which is rotatably fixed to the frame 30 via a first support member mount 310 thereof. Thereby, the surface sheet 7110 can slide along the support sheet 7120 such that it is laterally movable relative to the support sheet 7120 and the frame 30. Like this, the length of the first rest 710 can be adjusted as the need may be. Similarly, the surface sheet 7210 of the second rest 720 lies on top of the support sheet 7220 of the first rest 720 which is rotatably fixed to the frame 30 via a second support member mount 320 thereof.

The first rest 710 is connected to the back or pelvis support 730 via a first rest hinge structure 740 as first hinge component and the second rest 720 is connected to the back or pelvis support 730 via a second rest hinge 750 structure as second hinge component. The first and second rest hinge structures 740, 750 allow for compensating an up and down movement of the first and second rests 710, 720 induced by a tilting movement of the back or pelvis support 730 and the rocker flanks 410.

Figure 9:
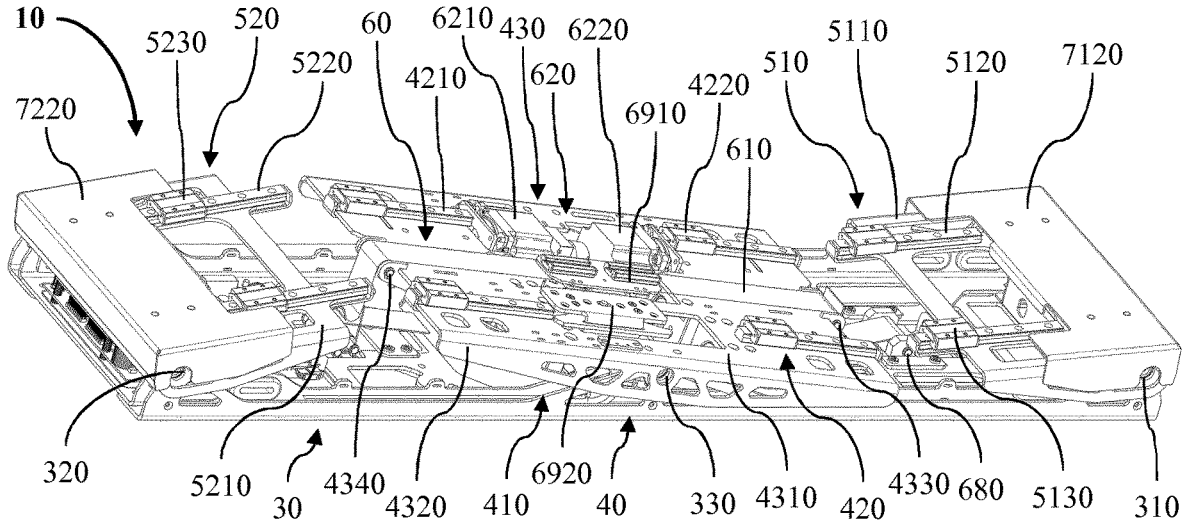
FIG. 9 shows the mobilization module of FIG. 8 wherein a body part support is removed.

In FIG. 9 the mobilization module 10 is shown partially disassembled such that details of the components underneath the back or pelvis support 730 and the first and second rests 710, 720 are visible. The movement mechanics 40 comprise a rocker base 430 of the rocker member which has a main plate 4310 and lateral side plates 4320 which vertically extend downwards from the lateral ends of the main plate 4310. Centrally, the side plates 4320 are tiltably fixed to a rocker member mount 330 of the frame 30. The side plates 4320 of the rocker base 430 are movable relative to the arc plates 4110 of the rocker flanks 410 (not visible in FIG. 9).

On a top surface of the main plate 4310 of the rocker base 430 a shifting member 420 with four rails 4210 is mounted. Starting from both longitudinal ends of the main plate 4310 a pair of the parallel rails 4210 extends to about a third of the length of the main plate 4310. Each of the rails 4210 is equipped with a slidable carriage 4220. The carriages 4220 are fixed to the bottom side of the back or pelvis support 730 (not visible in FIG. 9) such that the back or pelvis support 730 can move left and right along the rails 4210 relative to the rocker base 430.

Adjacent right to the rocker base 430 a first support member 510 and adjacent left to the rocker base 430 a second support member 520 are arranged. Each of the first and second support members 510, 520 have a sheet carrier 5110, 5210, two parallel rails 5120, 5220 and one carriage 5130, 5230 per rail 5120, 5220. The rails 5120, 5220 are straight and positioned in a prolongation of the respective neighbouring rails 4210 of the shifting members 420. The pair of carriages 5130 of the first support member 510 are fixed to the bottom side of the surface sheet 7110 of the first rest 710. The pair of carriages 5230 of the second support member 520 are fixed to the bottom side of the surface sheet 7210 of the second rest 720 (not visible in FIG. 9). Like this, the surface sheets 7110, 7210 can be moved relative to the respective support sheets 7120, 7220 and the frame 30. The first support member 510 is rotatably mounted to the frame 30 via its first support member mount 310 and the second support member 520 is rotatably mounted to the frame 30 via its second support member mount 320.

The mobilization module 10 further comprises a drive unit 60 having a strap 610, an electromotor set 620 and a strap tensioning unit 680. The strap 610 extends along the main plate 4310 of the rocker base 430 and from its longitudinal ends downward towards the frame 30. For turning the strap 610 downwardly towards the frame 30, the rocker base 430 is equipped with a right hand first rocker base pulley 4330 and a left hand second rocker base pulley 4340. The electromotor set 620 comprises a tilting motor 6210 and a translating motor 6220. Also visible in FIG. 9 are a tilting nut connector 6910 of the drive unit 60 and a translating nut connector 6920 of the connector which are described in more detail below.

Figure 10:
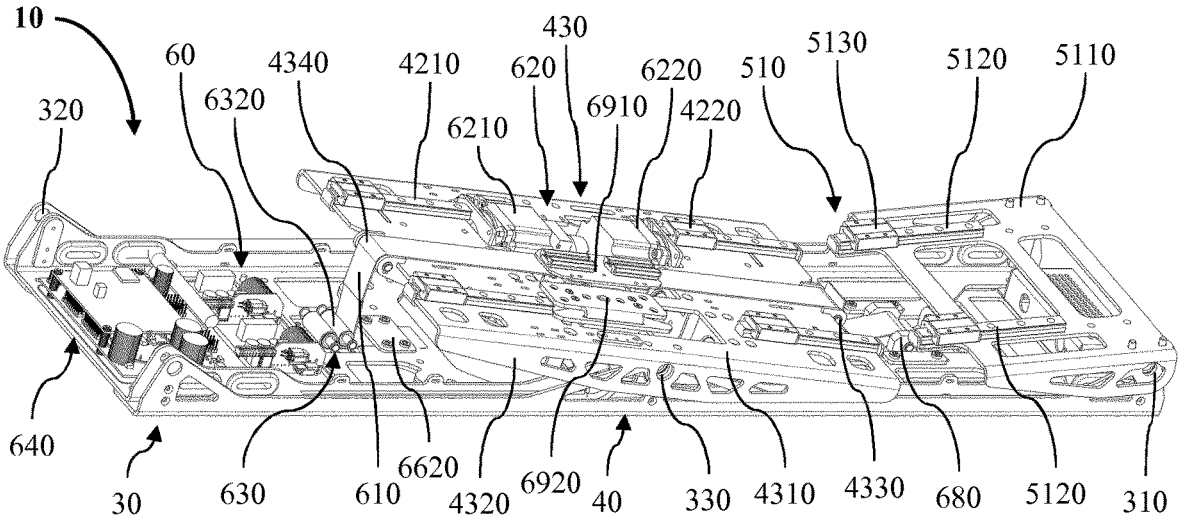
FIG. 10 shows a perspective view of the mobilization module of FIG. 8 partially disassembled.

As shown in FIG. 10, the drive unit 60 further comprises a set of pulleys 630 and a control unit 640. As can be seen on the left hand side of the rocker base 430 the strap 610 is redirected by the second rocker base pulley 4340 from the top surface of the main plate 4310 down towards a second traction pulley 6320 mounted to the frame 30. From the second traction pulley 6320 the strap 610 redirected by another pulley 630 and fixed to the frame 30 via second strap fixation 6620.

Figure 11:
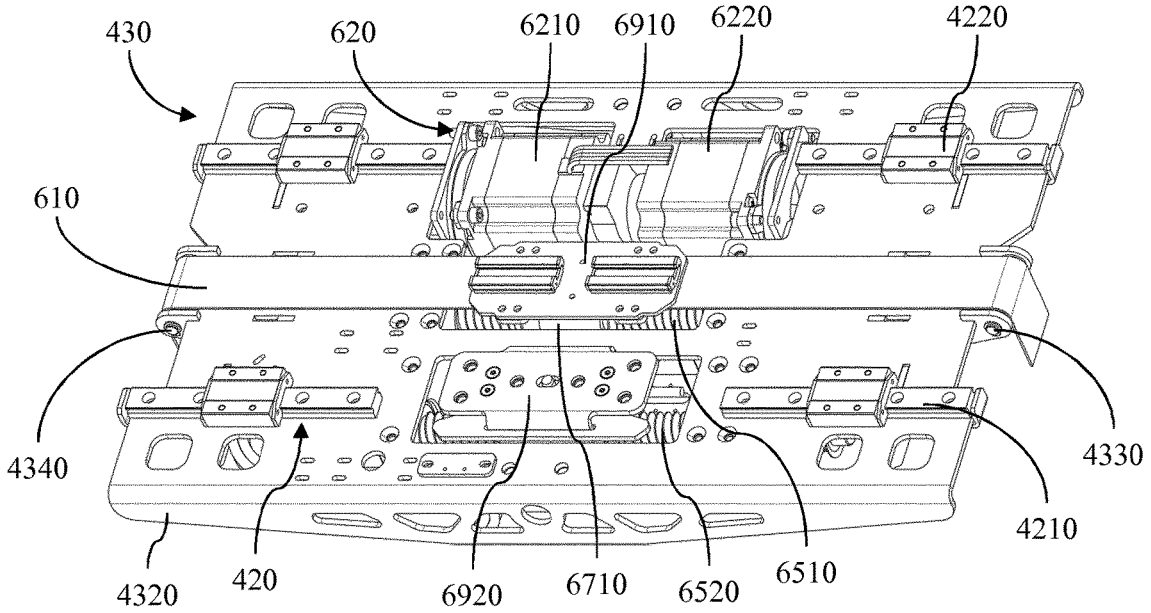
FIG. 11 shows a perspective from above on a rocker base and a portion of a drive unit of the mobilization module of FIG. 8.
Figure 12:
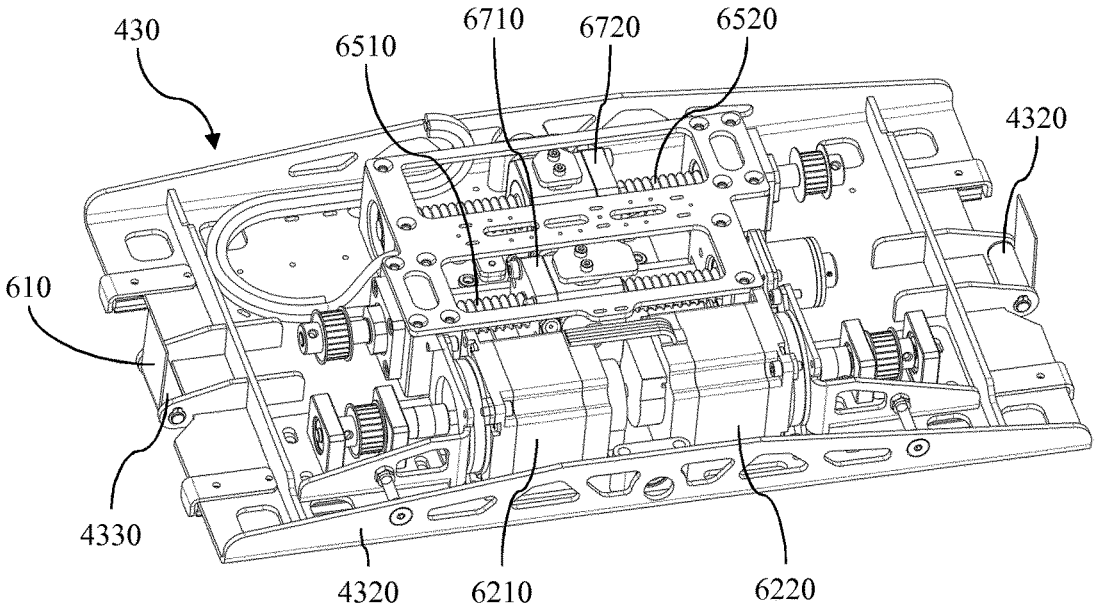
FIG. 12 shows a perspective from below on the rocker base and a portion of the drive unit of the mobilization module of FIG. 8.

FIG. 11 and FIG. 12 show details of the rocker base 430 and the drive unit 60. In particular, the drive unit 60 comprises a tilting spindle 6510 extending through a tilting nut 6710 and a translating spindle 6520 extending through a translating nut 6720. The spindles 6510, 6520 have an outer thread and the nuts 6710, 6720 have a corresponding inner thread engaging the respective outer thread. The tilting motor 6210 has on its left hand side a rotatable shaft which is connected to the tilting spindle 6510 via a drive belt (not visible in the Figs.). Similarly, the translating motor 6220 has on its right hand side a rotatable shaft which is connected to the translating spindle 6520 via another drive belt (not visible in the Figs.).

As can be best seen in FIG. 12, by operating the tilting motor 6210 the tilting spindle 6510 is rotated about its longitudinal axis. Thereby, due to the inter-engaging threads the tilting nut 6710 travels along the tilting spindle 6510 wherein the direction of travel of the tilting nut 6710 depends on the direction of rotation of the tilting spindle 6510. Thus, the tilting motor 6210 is arranged to move the tilting nut 6710 along the tilting spindle 6510 back and forth depending on the direction it rotates its shaft. The translating motor 6220, the translating spindle 6520 and the translating nut 6720 are correspondingly arranged such that the translating motor 6220 can move the translating nut 6720 along the translating spindle 6520 back and forth depending on the direction it rotates its shaft.

Turning back to FIG. 11, it can be seen that the strap 610 is fixed to the tilting nut 6710 by the titling nut connector 6910 which has two guiding elements on its upper surface. In an assembled state, the guiding elements of the titling nut connector 6910 are housed in a corresponding rail fixed to the lower surface of the back or pelvis support 730 such that the tilting nut connector 6910 is movable relative to the back or pelvis support 730 along the strap 610, i.e. in a lateral direction of the mobilization module 10, but fixed towards the strap 610 and the rocker base 430. The translating nut 6920 is fixed to the lower surface of the back or pelvis support 730 via the translating nut connector 6920 such that it is immovable relative to the back or pelvis support 730.

Figure 13:
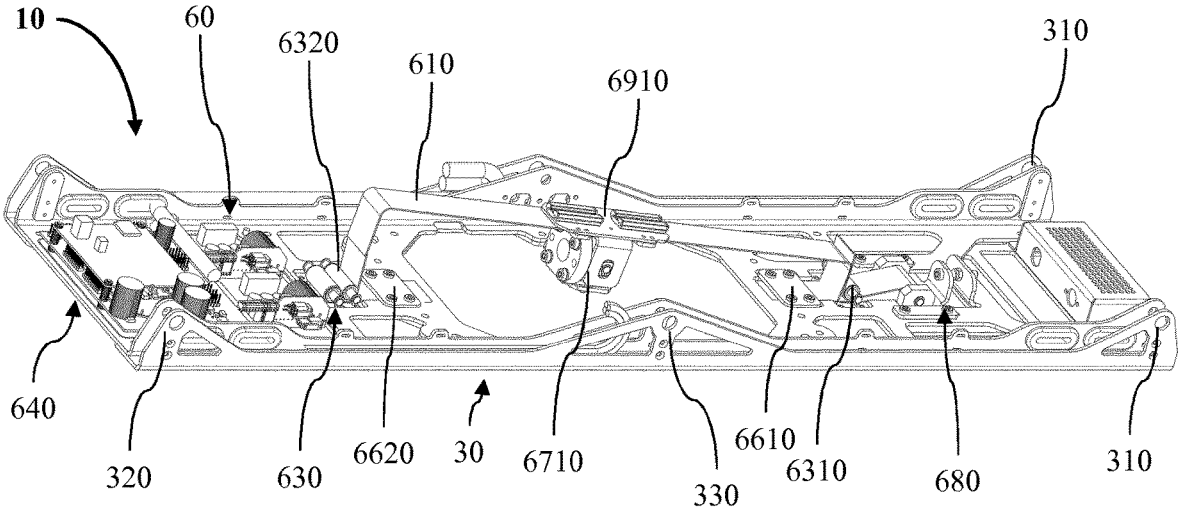
FIG. 13 shows a perspective view of a frame and a portion of the drive unit of the mobilization module of FIG. 8.

FIG. 13 shows details of the frame 30. In particular the design of the first support member mount 310, the second support member mount 320 and the rocker member mount 330 are visible.

Also, the course of the strap 610 can be seen in FIG. 13. In particular, the strap 610 is at its right hand side fixed to the frame 30 by a first strap fixation 6610 in form of a fixing plate screwed to the frame 30 and clamping the strap 610 to the frame 30. From the first strap fixation 6610 the strap 610 runs via the strap tensioning unit 680 to a first traction pulley 6310 which is mounted to the frame 30. The strap tensioning unit 680 is arranged to tension or loosen the strap 610 by means of a respective screw. Like this, the strain of the strap 610 can be adjusted. The first traction pulley 6310 redirects the strap 610 towards the upper surface of the rocker base 430 (not visible in FIG. 13).

At its left hand side the strap 610 is fixed to the frame 30 by the second strap fixation 6620, again, in form of a fixing plate screwed to the frame 30 and clamping the strap 610 to the frame 30. From the second strap fixation 6610 the strap 610 runs via a further one of the pulleys 630 to the second traction pulley 6320 which redirects the strap 610 towards the upper surface of the rocker base 430 (not visible in FIG. 13).

Figure 14:
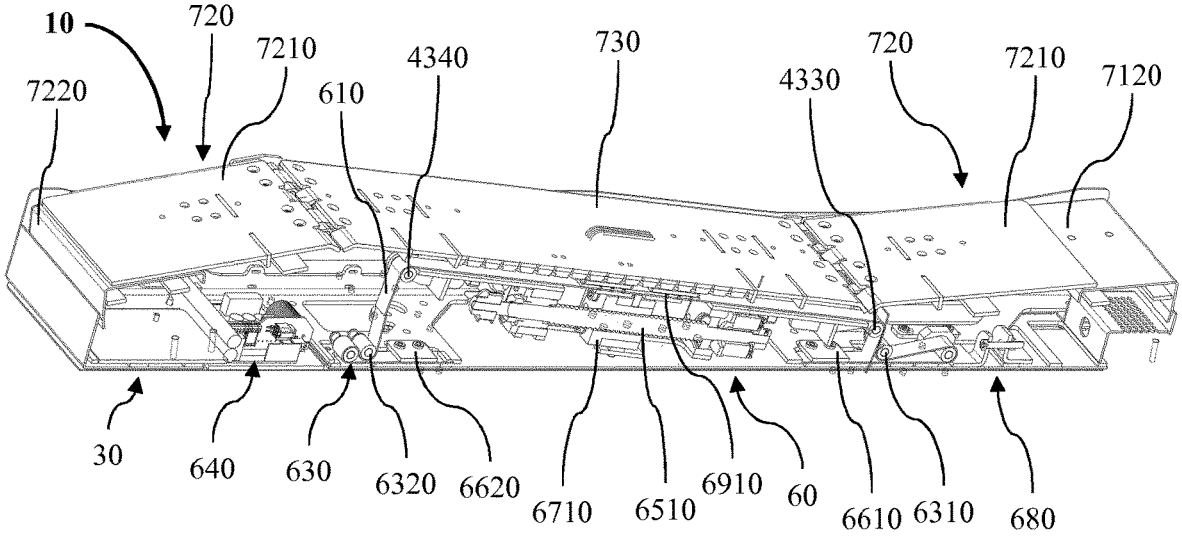
FIG. 14 shows a cut perspective view of the mobilization module of FIG. 8.

In FIG. 14 the mobilization module is shown in a cut view to illustrate its operation for moving the back or pelvis support 730. In particular, it can be seen that by moving the tilting nut 6710 along the tilting spindle 6510, the strap 610 is moved either in the direction of the first rocker base pulley 4330 or the second rocker base pulley 4340 depending on the direction into which the tilting spindle 6510 is rotated. Thereby, a distance between the first rocker base pulley 4330 and the first traction pulley 6310 as well as a distance between the second rocker base pulley 4340 and the second traction pulley 6320 change such that the rocker base 430 tilts either to the left or to the right. For example, when the tilting motor 6210 moves the tilting spindle 6710 to the right, a pulling force acts from the strap 610 to the second traction pulley 6320 which moves the second rocker base pulley 4340 towards the second traction pulley 6320. Thus, by moving the tilting nut 6710 to the right, the distance between the second base and traction pulleys 4340, 6320 is reduced such that the rocker base 430 is tilted to the left. Consequently, the rocker base 430 together with the back or pelvis support 730 can be tilted in both direction by means of the tilting motor 6210.

By moving the translating nut 6720 along the translating spindle 6520 the back or pelvis support 730 is directly linearly moved depending on the direction into which the translating spindle 6520 is rotated. In particular, by moving the translating nut 6720 along the translating spindle 6520, the back or pelvis support 730 is identically moved along the translating spindle 6520. For example, when the translating motor 6220 moves the translating spindle 6720 to the right, the back or pelvis support is also moved to the right to an identical extent.

By combining the tilting movement initiated by the tilting motor 6210 with the translational movement initiated by the translating motor 6220, an eight motion of the back or pelvis support 730 can be achieved. The control unit 640 is connected to the tilting and translating motors 6210, 6220 and controls their operation. It is programmable such that various types of movements of the back or pelvis support 730 are possible depending on the activation of the tilting and translating motors 6210, 6220.

When comparing the first mobilization module 1 to the second mobilization module 10 it is evident that the design of the second mobilization module 10 allows for optimizing space to movement ratio. In particular, by the set up of the second mobilization module 10 almost the identical extent of movements of the back or pelvis support 730 can be achieved but considerably less space is required. Like this, the second mobilization module can, e.g., better be integrated into a furniture or the like.

This description and the accompanying drawings that illustrate aspects and embodiments of the present invention should not be taken as limiting-the claims defining the protected invention. In other words, while the invention has been illustrated and described in detail in the drawings and foregoing description, such illustration and description are to be considered illustrative or exemplary and not restrictive. Various mechanical, compositional, structural, electrical, and operational changes may be made without departing from the spirit and scope of this description and the claims. In some instances, well-known circuits, structures and techniques have not been shown in detail in order not to obscure the invention. Thus, it will be understood that changes and modifications may be made by those of ordinary skill within the scope and spirit of the following claims. In particular, the present invention covers further embodiments with any combination of features from different embodiments described above and below.

The disclosure also covers all further features shown in the Figs. individually although they may not have been described in the afore or following description. Also, single alternatives of the embodiments described in the figures and the description and single alternatives of features thereof can be disclaimed from the subject matter of the invention or from disclosed subject matter. The disclosure comprises subject matter consisting of the features defined in the claims or the exemplary embodiments as well as subject matter comprising said features.

Furthermore, in the claims the word "comprising" does not exclude other elements or steps, and the indefinite article "a" or "an" does not exclude a plurality. A single unit or step may fulfil the functions of several features recited in the claims. The mere fact that certain measures are recited in mutually different dependent claims does not indicate that a combination of these measures cannot be used to advantage. The terms "essentially", "about", "approximately" and the like in connection with an attribute or a value particularly also define exactly the attribute or exactly the value, respectively. The term "about" in the context of a given numerate value or range refers to a value or range that is, e.g., within 20%, within 10%, within 5%, or within 2% of the given value or range. Components described as coupled or connected may be electrically or mechanically directly coupled, or they may be indirectly coupled via one or more intermediate components. Any reference signs in the claims should not be construed as limiting the scope.

The invention claimed is:

1. A mobilization module for mobilizing a body part of a patient, comprising:

a body part support;

a movement mechanics including a rocker member and a shifting member; and a drive unit, wherein the body part support is coupled to the rocker member and the shifting member of the movement mechanics, the movement mechanics is adapted to induce a controlled cadenced displacement of the body part support, the controlled cadenced displacement moves the body part support by at least 1 cm, at least 2 cm, at least 3 cm, at least 4 cm, at least 6 cm, at least 7 cm, at least 8 cm, at least 9 cm or at least 10 cm, the drive unit is connected to the movement mechanics to actuate the movement mechanics, the rocker member is oriented such that the body part support laterally tilts when the controlled cadenced displacement of the body part support is induced by the movement mechanics, the shifting member laterally shifts the body part support when the controlled cadenced displacement of the body part support is induced by the movement mechanics, and wherein the controlled cadenced displacement of the body part support induced by the movement mechanics comprises a figure eight motion of the body part support.

2. The mobilization module according to claim 1, comprising a first lateral hinge component and a second lateral hinge component, wherein the body part support has a central section passing over into a first lateral section at a first lateral side and passing over into a second lateral section at a second lateral side opposite to the first lateral side of the central section, the first lateral hinge component holds the body part support where the central section passes over into the first lateral section, and the second lateral hinge component holds the body part support where the central section passes over into the second lateral section.

3. The mobilization module according to claim 2, comprising a first length adjustable rest connecting the rocker member of the movement mechanics to the first lateral hinge component and a second length adjustable rest connecting the rocker member of the movement mechanics to the second lateral hinge component.

4. The mobilization module according to claim 1, wherein the shifting member of the movement mechanics comprises a rail and a carriage which is slidably arranged on the rail, and wherein the carriage is coupled to the body part support.

5. The mobilization module according to claim 1, wherein the movement mechanics comprises a rotator and a notch mounted to the rotator offset from an axis of rotation of the rotator, the rocker member of the movement mechanics comprises a central rest supporting the body part support, and the notch engages a recess of the central rest.

6. The mobilization module according to claim 5, wherein the recess of the central rest of the rocker member of the movement mechanics is a longitudinal groove.

7. The mobilization module according to claim 1, wherein the drive unit comprises a strap connected to the rocker member of the movement mechanics, such that the rocker member is tiltable by manipulating the strap.

8. The mobilization module according to claim 7, wherein the strap extends along the rocker member such that the rocker member is tiltable in one way by pulling the strap in one direction and in the other way by pulling the strap in the opposite other direction.

9. The mobilization module according to claim 1, wherein the drive unit comprises an electromotor coupled to the movement mechanics.

10. The mobilization module according to claim 1, comprising a housing in which the movement mechanics and the drive unit are arranged, and which is covered by the body part support.

11. The mobilization module according to claim 1, comprising a control unit arranged to predefine the controlled cadenced displacement of the body part support induced by the movement mechanics.

12. The mobilization module according to claim 1, wherein the body part support or at least a complete section thereof configured to receive the body part of the patient is rigid.

13. A mobilization furniture comprising:

a rest portion; and a body part portion with a body part support, a movement mechanics including a rocker member and a shifting member, and a drive unit, wherein the body part support of the body part portion is coupled to the rocker member and the shifting member of the movement mechanics of the body part portion, the movement mechanics of the body part portion is adapted to induce a controlled cadenced displacement of the body part support of the body part portion, the controlled cadenced displacement moves the body part support of the body part portion by at least 1 cm, at least 2 cm, at least 3 cm, at least 4 cm, at least 6 cm, at least 7 cm, at least 8 cm, at least 9 cm or at least 10 cm, the drive unit of the body part portion is connected to the movement mechanics of the body part portion to actuate the movement mechanics of the body part portion, the rocker member of the movement mechanics is oriented such that the body part support laterally tilts when the controlled cadenced displacement of the body part support is induced by the movement mechanics, the shifting member laterally shifts the body part support when the controlled cadenced displacement of the body part support is induced by the movement mechanics, and wherein the controlled cadenced displacement of the body part support of the body part portion induced by the movement mechanics of the body part portion comprises a figure eight motion of the body part support.

14. The mobilization furniture according to claim 13, wherein a mobilization module is comprised of the body part support, the movement mechanics, and the drive unit, and the mobilization module is integrated in the body part portion.

15. The mobilization furniture according to claim 13, wherein the body part support or at least a complete section thereof configured to receive the body part of the patient is rigid.

* * * * *